US006322409B1

(12) United States Patent
Hattori et al.

(10) Patent No.: US 6,322,409 B1
(45) Date of Patent: Nov. 27, 2001

(54) INJECTION SYSTEM FOR PERSONAL WATERCRAFT

(75) Inventors: Toshiyuki Hattori; Masayoshi Nanami, both of Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/260,327

(22) Filed: Mar. 1, 1999

(30) Foreign Application Priority Data

Feb. 27, 1998 (JP) ..... 10-046707

(51) Int. Cl.[7] ..... B63H 21/10
(52) U.S. Cl. ..... 440/88
(58) Field of Search ..... 123/445, 470, 123/730; 440/900, 38, 88; 114/55.5

(56) References Cited

U.S. PATENT DOCUMENTS

D. 237,956 * 12/1975 Naito et al. ..... 114/55.5
4,768,983 * 9/1988 Smith ..... 440/111
5,284,111 * 2/1994 Geyer et al. ..... 123/73 C
5,699,766 * 12/1997 Saito ..... 123/257
5,762,040 * 6/1998 Taipale et al. ..... 123/73 C

* cited by examiner

*Primary Examiner*—Ed Swinehart
(74) *Attorney, Agent, or Firm*—Ernest A. Beutler

(57) ABSTRACT

Several embodiments of personal watercraft having a V bottom hulls that define an engine compartment in which an internal combustion engine is positioned. This engine drives a propulsion device for the watercraft through an appropriate transmission. The engine includes an engine body having an opening into which a fuel injector injects. The fuel injector is positioned so that its spray axis is oriented so that it is not likely to intersect the walls of the engine that define the opening regardless of the angular position of the watercraft in the body of water in which it is operating. Both direct and manifold injected and two and four cycle engines are disclosed.

11 Claims, 7 Drawing Sheets

INJECTION SYSTEM FOR PERSONAL WATERCRAFT

BACKGROUND OF THE INVENTION

This invention relates to a personal watercraft and more particularly to an improved injection system for such watercraft.

There are a large number of personal watercraft in service. For the most part, these personal watercraft are powered by internal combustion engines and are subject to the same demands for more efficient fuel consumption and better combustion control and exhaust emission control as other engine applications. However, watercraft and particularly the small type of watercraft referred to as "personal watercraft" presents some unique problems in connection with exhaust emission control and fuel economy.

A frequently relied upon source of improving engine performance without deteriorating fuel economy or exhaust emission control is fuel injection. The fuel can be injected either directly into the combustion chamber or into the intake system for ingestion into the combustion chamber along with the intake air charge. Regardless of the type of injection employed, it is very important that the fuel be injected in such a way that it does not impinge to a significant extent on the engine walls where it might condense and collect. This condition can result in erratic fuel delivery and incomplete combustion.

This problem is particularly significant in connection with watercraft and particularly personal watercraft because these types of vessels frequently have their trim or pitch conditions changed significantly. Side-to-side rocking also can be quite extreme and thus, the angle of the fuel injector can vary considerably when the water vehicle travels along its path.

Thus, these various orientations which can be experienced can result in improper fuel delivery and improper or inadequate mixing of the fuel with the air, particularly when fuel injection is employed.

It is, therefore, a principal object of this invention to provide an improved fuel injection system for a personal watercraft engine.

It is a further object of this invention to provide an improved fuel injection system wherein the fuel injectors are mounted so that the portion of the engine into which they spray and this relationship will be such that the fuel is not likely to impinge on the walls of the area bounded by the area where the fuel is injected regardless of the disposition of the watercraft.

It is, therefore, the principal object of this invention to provide an improved fuel injection system for a personal watercraft.

SUMMARY OF THE INVENTION

This invention is adapted to be embodied in a personal watercraft having a hull that defines an engine compartment in which an internal combustion engine is positioned. This engine drives a propulsion device for the watercraft through an appropriate transmission. The engine includes an engine body having an opening into which a fuel injector injects. The fuel injector is positioned so that its spray axis is oriented so that it is not likely to intersect the walls of the engine that define the opening regardless of the angular position of the watercraft in the body of water in which it is operating.

DETAILED DESCRIPTION OF THE PREFERRED EMBODIMENTS OF THE INVENTION

Figure 1:
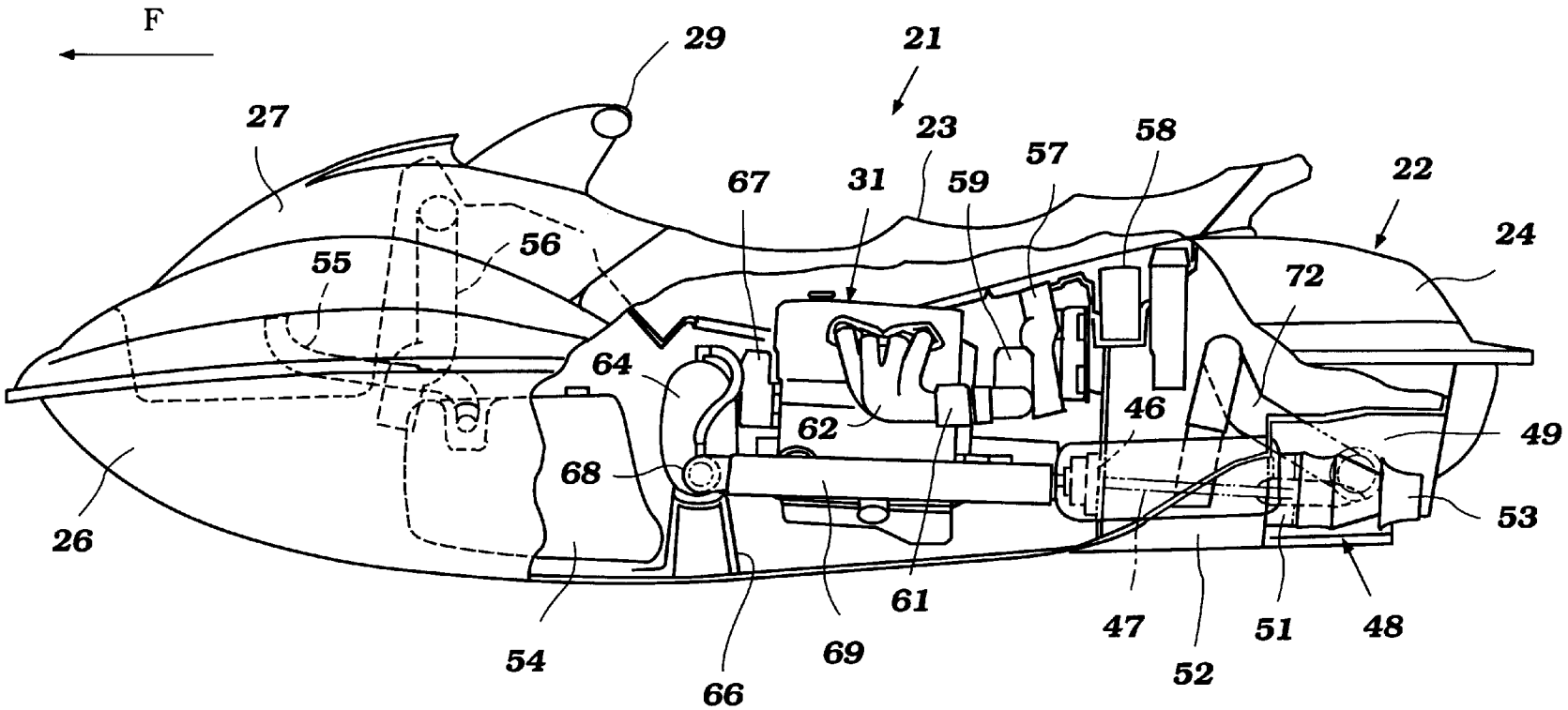
FIG. 1 is a side elevational view of a personal watercraft constructed in accordance with an embodiment of the invention, with a portion broken away so as to more clearly show the construction.
Figure 2:
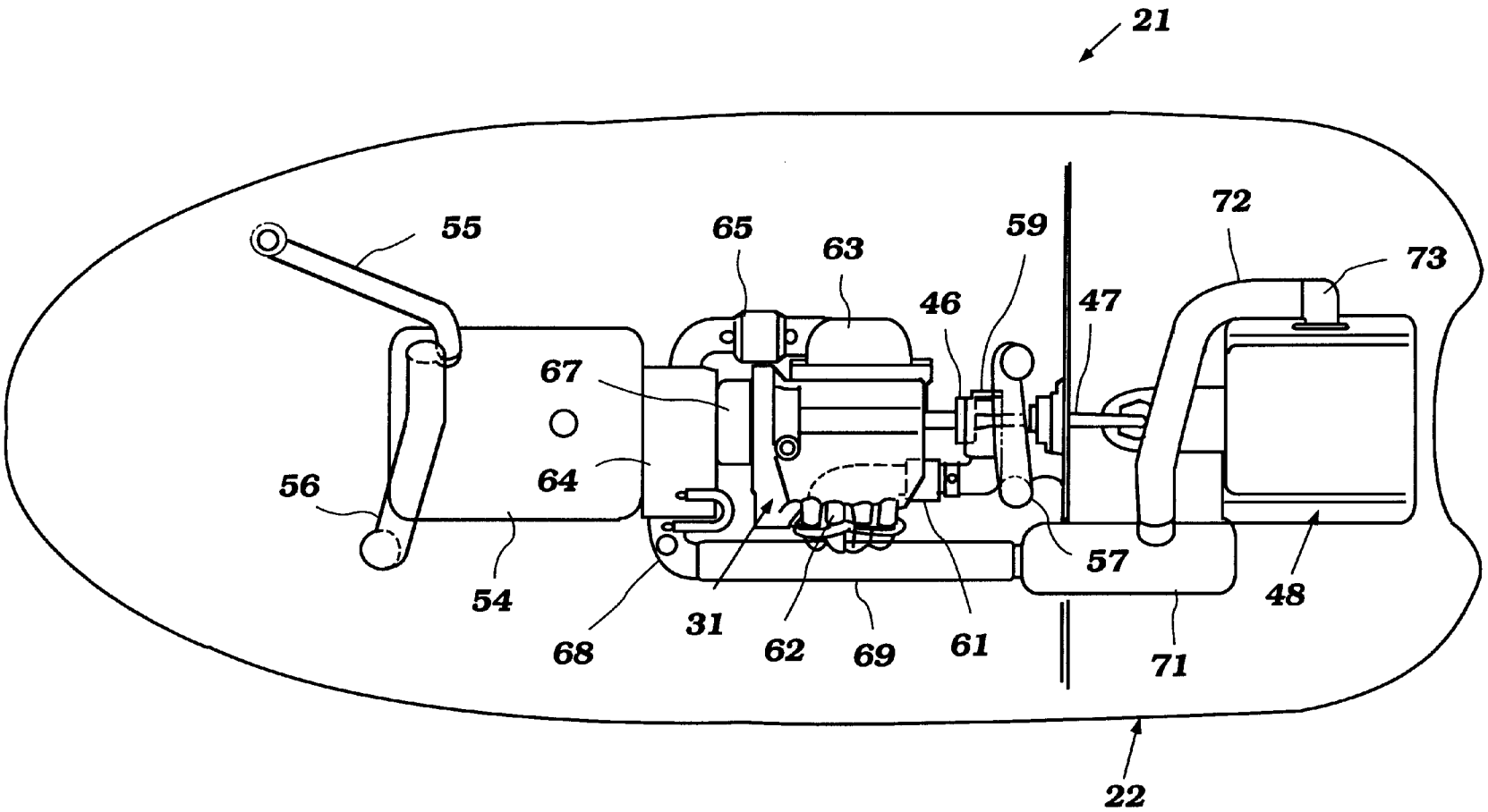
FIG. 2 is a top plan view of the watercraft with the hull being shown only in outline so that the number of the running components are more visible and can be shown in solid lines.

Referring now in detail to the drawings and initially to the embodiment of FIGS. 1–4, a small personal watercraft constructed in accordance with a first embodiment of the invention is indicated generally by the reference numeral 21. The watercraft 21, in accordance with the aforenoted definition of personal watercraft, is comprised primarily of a hull assembly, indicated generally by the reference numeral 22, which forms a rider's area at the rearward portion thereof which is defined primarily by a straddle type seat 23 that is disposed on a raised portion 24 of the hull 22 and which is bounded on its outer sides by a pair of foot areas 25. Riders are accommodated on the seat 23 in straddle tandem fashion with their feet in the foot areas 25. In the illustrated embodiment, the watercraft 21 and specifically its seat 23 is configured so as to accommodate a maximum of three riders seated in this fashion.

The hull 22 is comprised of a hull under part 26 to which a deck portion 27 is affixed in any known manner. Preferably, the hull portions 26 and 27 are formed from a molded fiberglass reinforced resin or a similar material. The hull portion 26 has a generally V shaped bottom, indicated generally by the reference numeral 28.

A control area including a mast 29 is provided on the deck portion 27 forwardly of the seat 23 so that the forward most seated rider may operate the watercraft 21.

Figure 3:
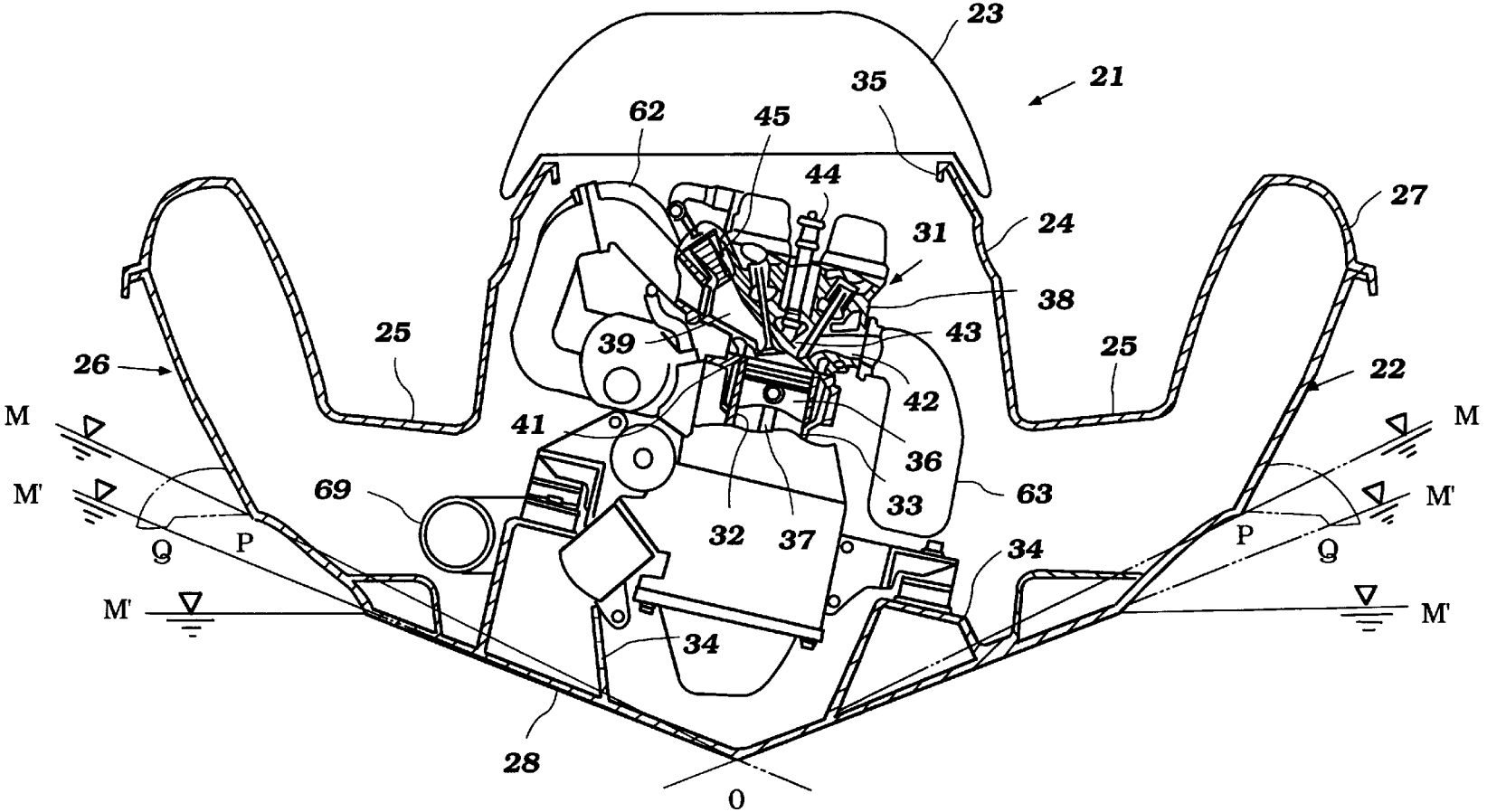
FIG. 3 is a cross-sectional view taken through the watercraft looking from the rear and shows a number of angular orientations through movement of the waterline so as to describe a principal feature of the invention.
Figure 4:
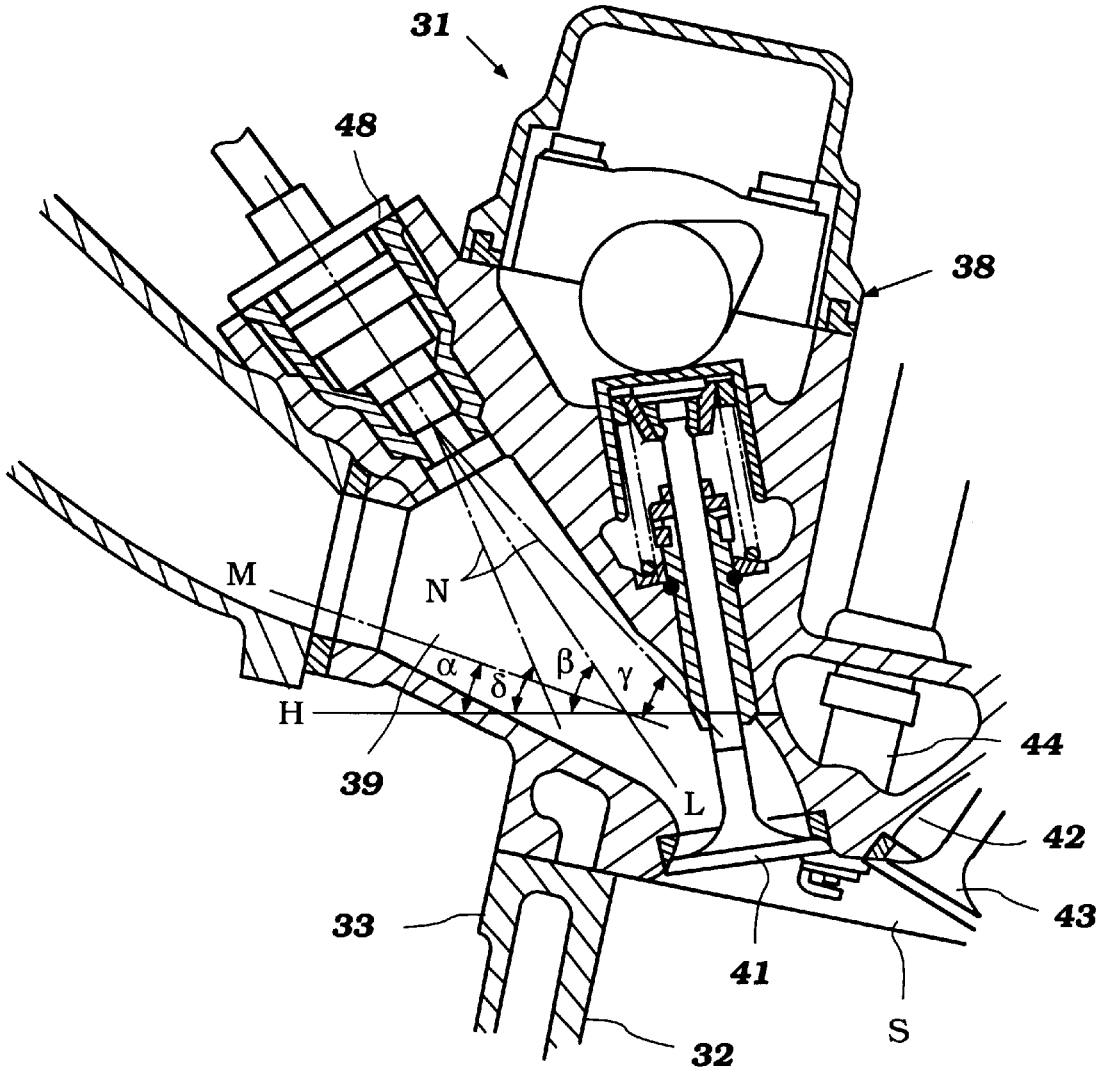
FIG. 4 is an enlarged cross-sectional view taken through a portion of the engine of this embodiment taken in the area where the fuel injector is positioned and injects.

The hull 22 forms an engine compartment that is located primarily below the seat 23 and in which an internal combustion engine, indicated generally by the reference numeral 31, is provided for supplying a propulsive force to the watercraft 21. Although the engine 31 may be of any known type, in this embodiment this engine is comprised of a four cycle, four cylinder, inline engine that is disposed so that its cylinder bores, indicated at 32 in FIGS. 3 and 4, are inclined slightly to one side of the vertical.

For this purpose, the cylinder block 33 of the engine 31 is mounted on a pair of pedestals 34 formed in the hull portion 26 and which have different heights. By canting the engine 31 to one side, the overall height of the package can be reduced and also the accessibility of the engine 31 for servicing can be facilitated.

It should be noted that the upper area of the hull raised portion 24 is provided with an access opening 35 which is closed by the seat 23 or by a removable portion of it so that the engine components can be accessed for service.

Pistons 36 reciprocate in the cylinder bores 32 and are connected by piston pins to the upper ends of connecting rods 37. These connecting rods 37 are journalled on the throws of a crankshaft, which does not appear in the drawings but which rotates about a longitudinally extending axis.

Still referring primarily to FIGS. 3 and 4, a cylinder head assembly 38 is affixed to the cylinder block 33 in closing relationship to the cylinder bores 32. The cylinder head 38 is provided with intake passages 39 through which a intake charge is delivered to the combustion chambers of the engine through an induction system, which will be described. These intake passages are valved by intake valves 41 that are operated by an overhead cam shaft mechanism of a suitable type.

In a like manner, exhaust passages 42 extend through the opposite side of the cylinder head assembly 38 and are communicated with the combustion chambers of the engine upon the opening of exhaust valves 43 which are also operated by this overhead cam mechanism. The induction and exhaust systems which cooperate with the intake passages 39 and exhaust passages 42 will be described later.

Spark plugs 44 are mounted in the cylinder head beneath the access opening 35 so as to afford easy access and also so as to fire the charge in the combustion chambers.

This charge is formed in part by fuel injectors 45 which, in this specific embodiment illustrated inject into the intake passages 39 in an orientation that will be described in more detail later.

It has been noted that the engine 31 is mounted in the hull so that its crankshaft rotates about a longitudinally extending axis. This is done so as to facilitate a driving connection to a transmission mechanism, indicated generally by the reference numeral 46 which couples the engine crankshaft to an impeller shaft 47 of a jet propulsion unit, indicated generally by the reference numeral 48. This jet propulsion unit is mounted at the rear portion of the hull underside in part in a tunnel area 49 formed to the rear thereof.

An impeller 51 (FIG. 1) is fixed to the impeller shaft and draws water through a downwardly facing water inlet opening 52 of the jet propulsion unit 48. This water is then discharged rearwardly through a discharge nozzle 53 so as to provide a propulsive force for the watercraft 21, in a manner well known in this art.

As is typical with this type of watercraft, the discharge nozzle 53 may be supported for steering motion about a vertically extending steering axis under the control of the watercraft control 29. In addition, this discharge nozzle may also be pivotal about a horizontally extending axis to provide trim adjustment for the watercraft.

It has been mentioned that the engine 31 is supplied with fuel by a fuel injection system which includes the fuel injectors 45. Fuel is supplied to the fuel injectors 45 from a fuel tank 54 which is mounted forwardly of the engine 31. This fuel tank 54 is provided with a fill pipe 55 that extends forwardly to an area of the deck portion 27 where it can be easily accessed for filling.

A ventilation system is provided for ventilating the engine compartment and also for delivering air to the induction system of the engine. This ventilating system includes a vent inlet pipe 56 that is disposed forwardly in the hull and which has an upper end that is exposed to the atmosphere and a lower end which discharges in an area immediately to the front of the fuel tank 54.

This air can then flow rearwardly through the engine compartment across the components which will be described for discharge through a vent discharge pipe 57 which extends upwardly to the rear of the engine 31 and discharges to the atmosphere through the area beneath the seat 23.

It has been noted that the seat 23 is in whole or in part removable to open the access opening 35 to afford service access to the engine 31. In addition, a storage compartment containing a battery 58 may be provided under the rearward portion of the seat for storing various articles and which may also be accessible through the removal of the seat or a further portion of it.

It has been noted that there is an induction system provided for supplying an air charge to the intake passages 39 of the cylinder head. This induction system will now be described and it appears in most detail in FIGS. 1–3.

This induction system includes an air inlet device, indicated generally by the reference numeral 59 which extends transversely across the rear portion of the engine 31 and has a sidewardly facing inlet duct across which a filter element may be positioned. At the end of the inlet device 59 opposite to the inlet duct, there is provided a throttle body 61 which extends generally in a longitudinal direction along one side of the engine 31. This throttle body 61 communicates with an intake manifold arrangement 62 that is disposed on this side of the engine and which is also accessible through the hull opening 35 upon removal of the seat portion 23.

This intake manifold thus is in a fairly compact location and also is disposed so that the inlet duct 61 will receive air that has been admitted through the engine compartment through the ventilating system already described.

An exhaust manifold, indicated generally by the reference numeral 63 is affixed to the cylinder head assembly 38 on the side opposite that of the intake manifold 62. This exhaust manifold 63 is provided with a plurality of runner sections, each of which cooperate with a respective one of the cylinder head exhaust passages 42. The exhaust gases are then routed forwardly toward an acoustical exhaust silencer device, indicated generally by the reference numeral 64.

The exhaust manifold 63 communicates with the silencer device 64 through a conduit section in which a catalyst bed 65 is provided. The catalyst bed 65 is, therefore, positioned in a location where it will receive heated exhaust gases so as to operate at the appropriate temperature.

The silencing device 64 is mounted on the front of the cylinder block 33 upon a supporting pedestal 66 formed integrally with the hull portion 26. This leaves a space to the front of the engine 31 that is open.

The engine 31 may be provided with a dry sump lubrication system and a dry sump oil tank 67 can be conveniently positioned in this open space between the engine 31 and the exhaust silencing device 64. This will also be cooled by the aforenoted air flow.

The silencing device 64 may incorporate any form or forms of acoustical silencing devices for silencing the exhaust sounds. The silencing device 64 discharges the exhaust gases through a discharge pipe 68 formed in a lower portion thereof. This pipe 68 cooperates with an exhaust pipe 69 that extends rearwardly along the side of the engine opposite to the exhaust manifold 63 and rearwardly within the hull 22.

At an area to the rear of the hull and adjacent the one side of the jet propulsion unit 48, there is provided a water trap device, indicated generally by the reference numeral 71. This water trap device has a fairly large volume and is, as is known in the art, designed so as to trap water and to preclude its ability to flow to the engine through the exhaust system.

The water trap device 71 has disposed in an upper portion of it a discharge tube that is connected to a flexible conduit 72 which extends upwardly and transversely across the rear portion of the watercraft hull 22 so as to enter the tunnel area 49 through an exhaust discharge 73. Thus, this pipe 72 acts a further trap section to ensure that the water will be discharged from the cooling system back to the body of water in which it is operating and will avoid ingestion of water into the engine through the exhaust system.

The construction of the watercraft 21 and the engine 31 as thus far described may be considered to be conventional. However, the invention deals primarily with the orientation of the fuel injector 45 relative to the portion of the intake passage 39 into which it injects, and also the relationships of this to the hull configuration. Therefore, where any construction of the watercraft or engine has not been described, those skilled in the art may use any known constructions with which to practice the invention which will now be described.

It has been noted that the hull 22 has a V bottom 28. As seen in FIG. 3, this V bottom portion of the hull terminates at an apex O that extends along the line on the center plane of the hull 22. When riding normally in the body of water in which the watercraft is operated, the hull will assume a horizontal orientation in the water indicated by the waterline H in this figure.

However, when turning because of the V bottom shape, the hull will incline to one side or the other as indicated by the shifted horizontal lines M depending upon whether a right or left hand turn is being executed. If the watercraft hull is as configured with no added sponsons, the maximum inclination will be determined by the point P formed on chines on the outer part of the hull. If there are sponsons employed, as shown in phantom line, then the maximum inclination will be less determined by the outermost point Q on the chines. Hence, the maximum inclination under this condition is M'. Thus, these lines indicate the maximum inclination that may exist with normal running of the watercraft.

Referring now to FIG. 4, it will be seen that the intake passages 39 have a configuration into which the fuel injection nozzles 45 discharge. These nozzles 45 have a spray axis L which is directed generally toward the seat for the intake valve 41. The spray has an angle indicated at N which is generally conical in configuration. In accordance with the invention, the fuel injector 45 is mounted so that the spray axis L will be disposed at an angle θ to the horizontal plane H and which passes generally centrally in the portion of the intake passage. In the normal horizontal position of the watercraft, the outer peripheral portion of the spray from the nozzle is related to the horizontal axis so that it extends at an angle δ. Also, the outer peripheral portion of the spray closest to the stem of the intake valve 41 is disposed at an angle γ to the horizontal axis.

When the watercraft is at a maximum tilt in one direction, the line M, which passes through the center of the spray axis L, is at an angle α. In order to ensure that the fuel delivery will be uniform and the amount of fuel impingement on the walls of the intake passage does not vary significantly during these extreme running conditions, the following relationship exists:

$$\alpha<\gamma<\beta<\delta$$

Thus, by mounting the injectors in this relationship with the configuration chosen, the amount of fuel inducted into the combustion chamber on each cycle will be constant or substantially constant and the amount of impingement will be substantially reduced.

Figure 5:
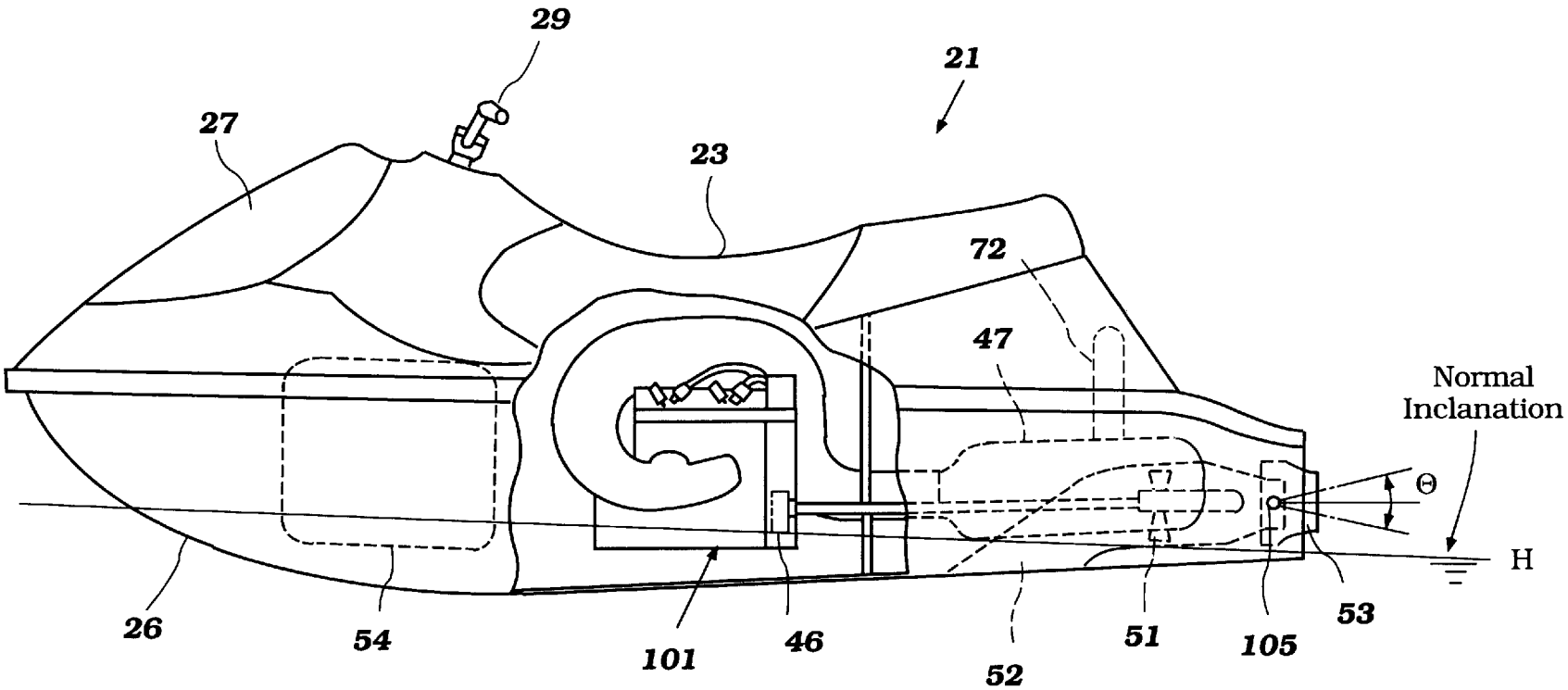
FIG. 5 is a side elevational view, in part similar to FIG. 1 and shows another embodiment of the invention.
Figure 6:
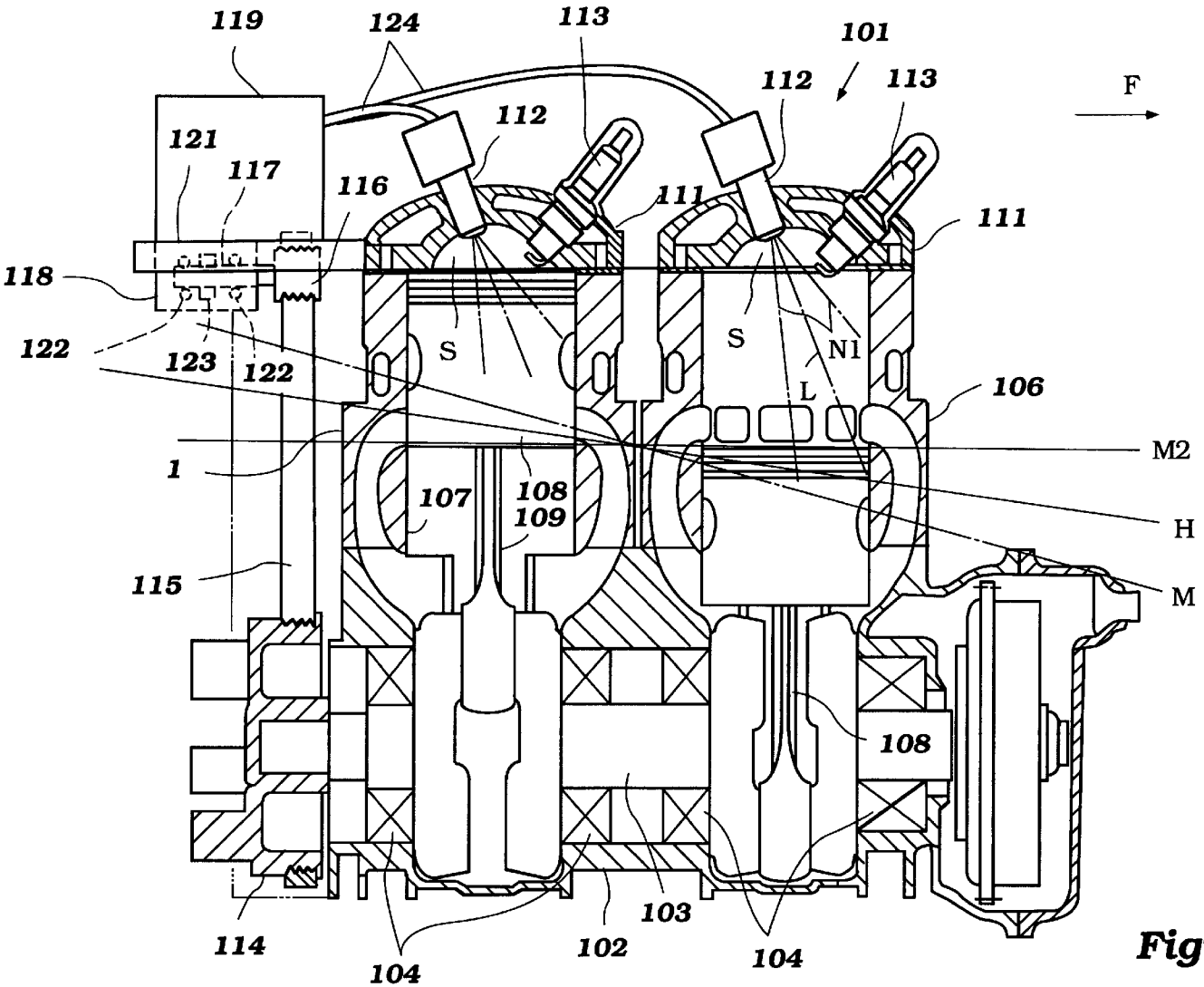
FIG. 6 is a longitudinal cross-sectional view through the engine of this embodiment and shows the relation of the fuel injectors thereto.
Figure 7:
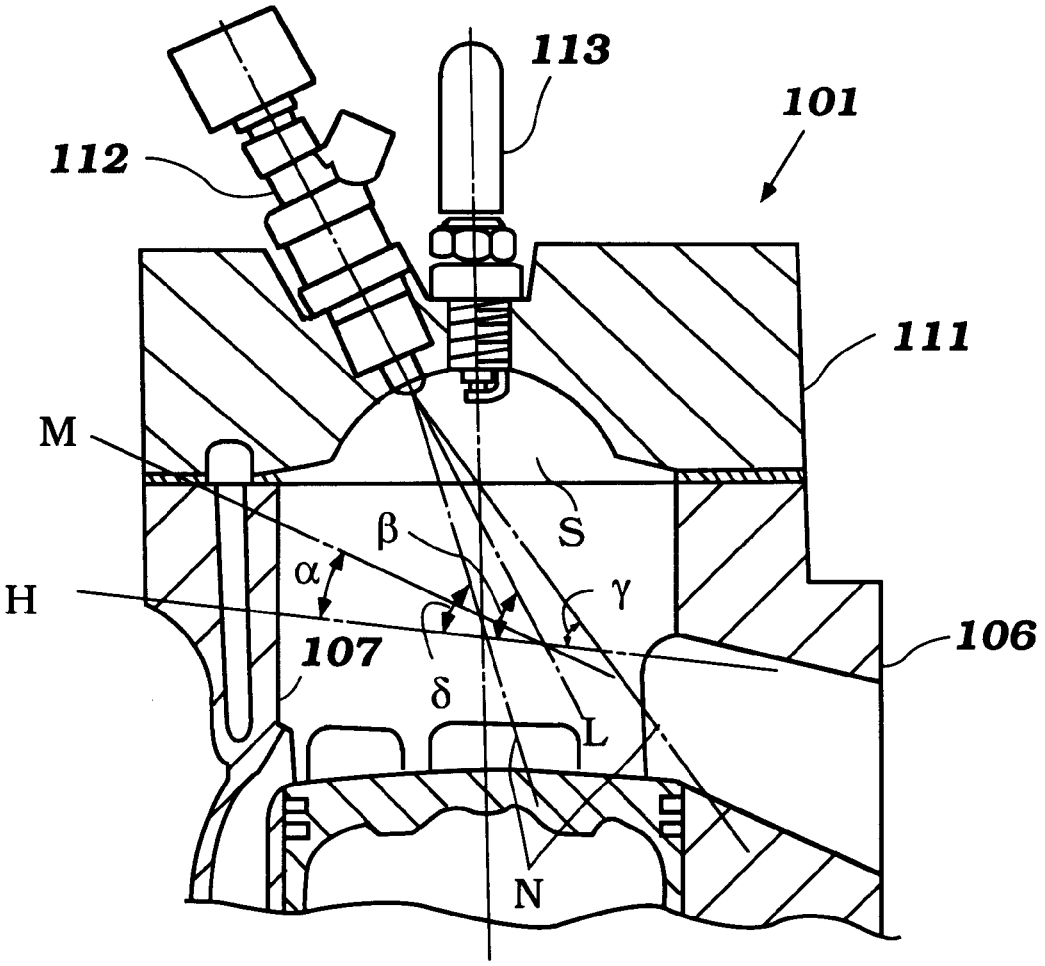
FIG. 7 is a cross-sectional view taken along a plane perpendicular to that of FIG. 6.

The foregoing description has been that of a four-cycle engine and one having manifold injection. The same principles, however, also apply with two-cycle engines, with direct injected engines of any type and also apply when conditions with trim angle is changed as well as when turning. FIGS. 5–7 show another embodiment of the invention that depicts these principles and shows how the invention can be practiced with a direct injected engine.

In this embodiment, the configuration of the watercraft and its general mounting of component is the same as that previously described. Therefore, the components are the same or substantially the same in this embodiment have been identified by the same reference numerals and will not be described, except insofar as is necessary to understand the construction and operation of this embodiment In this embodiment, the watercraft 21 is powered by a two-cylinder, two-cycle, directed injected internal combustion engine, indicated generally by the reference numeral 101. As seen primarily in FIG. 6, the engine 101 is comprised of a crankcase member 102 in which a crankshaft 103 is journaled for rotation about an axis that is defined by main bearings 104. This axis is disposed at a slight inclination during normal running to the water level H as seen in FIG. 5.

As has been previously noted, however, the trim angle can be adjusted by mounting the steering nozzle 53 of the jet propulsion unit 48 for movement about a horizontal trim axis, this being indicated at 105 in FIG. 5. The nozzle 53 is adjustable through an angular range indicated at θ. Thus, When viewed in FIG. 6, the angular disposition of the watercraft may vary from the line H to the maximum trim-up position indicated at M2 and the maximum trim-down position indicated at M. Thus, like the angular turning leaning, this also will affect fuel injection characteristics as will become apparent shortly.

Cylinder blocks 106 are affixed to the crankcase member 102 and define cylinder bores 107 in which pistons 108 reciprocate. The pistons 108 are connected by connecting rods 109 to the throws of the crankshaft 103 so as to drive it.

Cylinder heads 111 are affixed to and close the upper ends of the cylinder bores 107. These cylinder heads 111 have combustion chamber recesses S which at top dead center form the clearance volume for the engine and hence the reference character S is also used to identify the combustion chamber of the engine.

Fuel injectors 112 are mounted in the cylinder heads 111 in an angular orientation which will be described and which is shown in FIGS. 6 and 7. FIG. 6 shows the four aft inclination of these fuel injectors 112 and FIG. 7 shows the side inclination of them.

The engine 101 is provided with a suitable induction and exhaust system and since this forms no part of the invention, it has not been illustrated and description of it is not believed to be necessary to permit those skilled in the art to practice the invention. Spark plugs 113 are mounted in the cylinder heads 111 and preferably are disposed so as to be toward the center of the axis of the cylinder bore.

Because this engine 101 uses direct cylinder injection, fuel must be supplied to the fuel injectors 112 at a higher pressure than the manifold type of injection system previously described. Therefore, there is provided a drive pulley 114 that is fixed to the forward end of the crankshaft 103 and which drives a drive belt 115. This drive belt 115 drives a driven pulley 116 that is connected to a high pressure fuel pump drive shaft 117. This drive shaft 117 is journaled within a transmission housing 118 of a high pressure fuel pump 119. This fuel pump 119 is mounted on the one of the cylinder heads 111 by mounting brackets 112.

The pump drive shaft 117 is journaled by spaced bearings 122 and between these bearings is provided with one or more cam lobes 123 that drive plungers of the pump 119 so as to pressurize the fuel and deliver it to the injectors 112 through suitable conduits 124.

Referring now specifically to FIG. 6, the fore/aft orientation of the injectors will be described. As previously, the injectors have a spray axis L that defines the center of the spray cone N from these injectors. The injectors are mounted so as to spray in the fore and aft direction in a generally vertical plane so that the angle of the peripheral edge of the spray extends nearly perpendicularly to the horizontal axis H. Thus, when the trim angle is changed, there will be a minimum effect in the fuel impingement on the cylinder bores 107 and uniform air/fuel ratios will result.

Also, the fuel injectors 112 are disposed at an angle from the vertical and away from the exhaust side of the engine as seen in FIG. 7. Thus, the spray cone N is disposed so that it has the same relationships to the horizontal and maximum lean line H and M as when manifold injection is used and as previously described. That is:

$$\alpha<\gamma<\beta<\delta$$

Thus, from the foregoing description it should be readily apparent that the described construction permits the utilization of fuel injection with a watercraft wherein the fuel injection amounts and hand delivery to the combustion chamber in a burnable form will be substantially uniform regardless of whether the watercraft is traveling straight or leaning and regardless of its trim angle adjustment. Of course, the foregoing description is that of a preferred embodiment of the invention and various changes and modifications may be made without departing from the spirit and scope of the invention, as defined by the appended claims.

What is claimed is:

1. A personal watercraft having a hull that defines an engine compartment in which an internal combustion engine is positioned, said engine driving a propulsion device for said personal watercraft through a transmission, said engine including an engine body having an opening into which a fuel injector injects for delivery to a combustion chamber of said engine, said fuel injector being positioned so that its spray axis is oriented so that under normal engine operating conditions the fuel spray will not intersect the walls of said engine body that define said opening regardless of the angular position of said personal watercraft in the body of water in which it is operating.

2. A personal watercraft as set forth in claim 1 wherein the opening forms a portion of an induction system for the engine.

3. A personal watercraft as set forth in claim 2 wherein the opening is formed in an inlet passage of a cylinder head of the engine.

4. A personal watercraft as set forth in claim 1 wherein the opening comprises a combustion chamber of the engine.

5. A personal watercraft as set forth in claim 1 wherein the hull has a V bottom and the engine output shaft rotates about a longitudinal axis.

6. A personal watercraft as set forth in claim 5 wherein the fuel injector has a spray axis that is disposed at an acute angle $\beta$ to a horizontal plane when said watercraft is in a static, floating condition in the water.

7. A personal watercraft as set forth in claim 6 wherein the fuel injector has a conical spray the peripheral edges of which are disposed at acute angles $\delta$ and $\gamma$ to a horizontal plane when said watercraft is in a static, floating condition in the water.

8. A personal watercraft having a hull that defines an engine compartment in which an internal combustion engine having a combustion chamber is positioned, said engine driving a propulsion device for said personal watercraft through a transmission, said engine including an engine body having an opening into which a fuel injector injects for delivery to said combustion chamber, said hull having a V bottom and said engine having an output shaft that rotates about a longitudinal axis of said hull, said fuel injector having a spray axis that is disposed at an acute angle $\beta$ to a horizontal plane when said watercraft is in a static, floating condition in the water and a conical spray the peripheral edges of which are disposed at acute angles $\delta$ and $\gamma$ to a horizontal plane when said watercraft is in a static, floating condition in the water, the maximum normal lean angle of the hull in the water during turning is $\alpha$ and the following relation is true:

$$\alpha<\gamma<\beta<\delta.$$

9. A personal watercraft as set forth in claim 8 wherein the opening forms a portion of an induction system for the engine.

10. A personal watercraft as set forth in claim 9 wherein the opening is formed in an inlet passage of a cylinder head of the engine.

11. A personal watercraft as set forth in claim 8 wherein the opening comprises a combustion chamber of the engine.

* * * * *